US007978991B2

(12) United States Patent
Tomiie

(10) Patent No.: US 7,978,991 B2
(45) Date of Patent: Jul. 12, 2011

(54) IMAGE FORMING APPARATUS

(75) Inventor: Norio Tomiie, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 719 days.

(21) Appl. No.: 12/072,749

(22) Filed: Feb. 28, 2008

(65) Prior Publication Data

US 2008/0304842 A1 Dec. 11, 2008

(30) Foreign Application Priority Data

Mar. 6, 2007 (JP) ..... 2007-055487

(51) Int. Cl.
*G03G 15/00* (2006.01)
*G03G 15/02* (2006.01)

(52) U.S. Cl. ..... 399/44; 399/50

(58) Field of Classification Search ..... 399/44, 399/50

See application file for complete search history.

(56) References Cited

U.S. PATENT DOCUMENTS

| | | | | |
|---|---|---|---|---|
| 4,851,960 | A | 7/1989 | Nakamura et al. | |
| 5,805,954 | A | 9/1998 | Takahashi | |
| 6,532,347 | B2 | 3/2003 | Watanabe et al. | |
| 7,403,728 | B2 * | 7/2008 | Fletcher et al. | 399/50 |
| 7,532,831 | B2 * | 5/2009 | Kitano | 399/50 |

FOREIGN PATENT DOCUMENTS

| | | |
|---|---|---|
| JP | 63-149668 | 6/1988 |
| JP | 8-328362 | 12/1996 |
| JP | 2001-201920 | 7/2001 |
| JP | 2001-201921 | 7/2001 |
| JP | 2004-333789 | 11/2004 |
| JP | 2006-171282 | 6/2006 |

* cited by examiner

*Primary Examiner* — David M Gray
*Assistant Examiner* — Gregory H Curran
(74) *Attorney, Agent, or Firm* — Jordan and Hamburg LLP

(57) ABSTRACT

An image forming apparatus includes a high voltage generating circuit 91 that applies an oscillating voltage in which a DC voltage and an AC voltage are superimposed on each other, to a charging member 42 disposed in contact with an image carrier 41; a voltage control portion 96 that controls a peak-to-peak voltage of the AC voltage to a target voltage value; and an initial voltage adjusting portion 95 that sets a target voltage value based on a DC current value between the image carrier 41 and the charging member 42 which is detected by a current detecting portion 92. When an environmental condition which is used when the target voltage value is set changes, the initial voltage adjusting portion 95 performs an interrupt operation during an image forming process.

5 Claims, 10 Drawing Sheets

IMAGE FORMING APPARATUS

This application is based on an application No. 2007-055487 filed in Japan, the contents of which are hereby incorporated by reference.

BACKGROUND OF THE INVENTION

1. Field of the Invention

The present invention relates to an image forming apparatus including a high voltage generating circuit that applies an oscillating voltage in which a DC voltage and an AC voltage are superimposed on each other, to a charging member disposed in contact with or dose to an image carrier, and a voltage control portion that controls a peak-to-peak voltage value Vpp of the AC voltage to a target voltage.

2. Description of the Related Art

In recent years, as a charging control apparatus to be mounted in an image forming apparatus, in view of a low voltage process in which a charging control voltage to an image carrier is reduced, reduction in amount of ozone generated in charging control, reduction in cost, and the like, a charging control apparatus that employs a contact charging system has become mainstream, in which system an image carrier surface is uniformly charged by disposing a charging member of a roller type, a blade type, or the like, in contact with or dose to the surface of an image carrier and applying an oscillating voltage in which a DC voltage and an AC voltage are superimposed on each other, to the charging member. In this system, for the oscillating voltage, not only a sine wave but also any oscillation waveform that periodically changes, such as a rectangular wave, a triangular wave, or a pulse wave, can be employed.

Japanese Laid-Open Patent Publication No. 63-149668 discloses that in a case where such a contact charging system is employed, the following charging characteristics are exhibited.

Specifically, when a peak-to-peak voltage value of an AC voltage in an oscillating voltage is raised, a charging voltage of an image carrier increases in proportion thereto; when the peak-to-peak voltage value reaches about twice a charging start voltage by a DC voltage, a charging potential is saturated, and thus even if the peak-to-peak voltage value is further raised, the charging potential does not change; in order to ensure uniformity in charging, there is a need to apply an oscillating voltage having a peak-to-peak voltage that is twice or more the charging start voltage obtained upon the DC voltage application which is determined by various characteristics and the like of the image carrier; a charging voltage obtained at the time depends on a DC component of the applied voltage; and the like.

Accordingly, an oscillating voltage in which a peak-to-peak voltage of an AC voltage is set to a voltage value greater than or equal to a value (hereinafter, referred to as an "inflection point voltage") at which a charging potential does not change even when the peak-to-peak voltage is raised to a value greater or equal to the value thereof, needs to be applied to a charging member. Note, however, that the inflection point voltage changes with a resistance value of the charging member, use environment such as temperature and humidity, deterioration over time, and the like, and thus, normally, the peak-to-peak voltage is set to a voltage having an allowance of the order of 1.5 to 2 times a pre-confirmed inflection point voltage.

However, in an area where the peak-to-peak voltage is greater than or equal to the inflection point voltage, the amount of discharge increases due to opposite discharge, and therefore the amount of ozone generated increases. Since ozone is generated near the charging member and the image carrier, a discharge product such as nitrogen oxides (NOx) which is generated from air decomposed by ozone is likely to adhere to the image carrier. When the amount of adhesion of such a discharge product increases, due to an increase in kinetic friction resistance of the surface of the image carrier, there arises a problem such as occurrence of cleaning failure due to toner escaping through a cleaner blade or occurrence of an image flow due to leakage of charge.

In view of this, in order to suppress the cleaning failure or the image flow which occurs when an oscillating voltage in which an AC voltage is superimposed on a DC voltage is applied to the charging member, the present inventors have attempted to perform so-called calibration of a charging bias voltage in which during a period in which an image forming operation is not immediately executed, i.e., when the power to the image forming apparatus is turned on, or when the image forming apparatus returns to a normal operation mode from an energy saving mode, the peak-to-peak voltage of the AC voltage is corrected to a minimum necessary voltage value, i.e., a voltage value that is greater than or equal to an inflection point voltage and near the inflection point voltage.

However, in a case where the image forming apparatus is in a low temperature environment, there appear temperature characteristics that the resistance value of the charging member exhibits a higher value than that in a room temperature environment or a high temperature environment.

When the power to the image forming apparatus is turned on or when the image forming apparatus returns to the normal operation mode from the energy saving mode, the image forming apparatus is likely to be in such a low temperature environment, and when a printing operation is repeated thereafter, along with an increase in temperature inside the apparatus, the temperature of the charging member increases, and the resistance value of the charging member decreases accordingly.

When calibration is performed in such a low temperature environment, since the peak-to-peak voltage of the AC voltage is adjusted in accordance with the resistance value of the charging member corresponding to the temperature at that time, if the temperature of the charging member increases with the later increase in environmental temperature and the resistance value of the charging member decreases accordingly, it invites a situation where a peak-to-peak voltage which is exceptionally higher than a target, appropriate peak-to-peak voltage corresponding to the charging voltage of the image carrier is applied.

This is because an inflection point voltage obtained when the resistance value of the charging member is low is lower than an inflection point voltage obtained when the resistance value of the charging member is high.

If such a condition continues, the amount of discharge product that adheres to the image carrier increases, causing inconvenience such as cleaning failure and an image flow.

SUMMARY OF THE INVENTION

In view of the above-described conventional problems, it is an object of the present invention to provide an image forming apparatus capable of suppressing the occurrence of cleaning failure and an image flow even when the temperature of a charging member is changed.

According to one aspect of the present invention, there is provided an image forming apparatus including a charging member disposed in contact with or close to an image carrier, the image forming apparatus including: a high voltage generating circuit that applies an oscillating voltage in which a DC voltage and an AC voltage are superimposed on each other, to the charging member; a voltage control portion that controls the high voltage generating circuit such that a peak-to-peak voltage value of the AC voltage reaches a target voltage value; and an initial voltage adjusting portion that sets the target voltage value when power to the image forming apparatus is turned on or when the image forming apparatus returns from a power saving mode, interrupts an image forming process being performed, and suspends the image forming process to set the target voltage value.

Other aspects of the present invention will become apparent with reference to the following embodiments.

DESCRIPTION OF THE PREFERRED EMBODIMENTS

An image forming apparatus to which the present invention is applied will be described below using a digital copier as an example.

Figure 2:
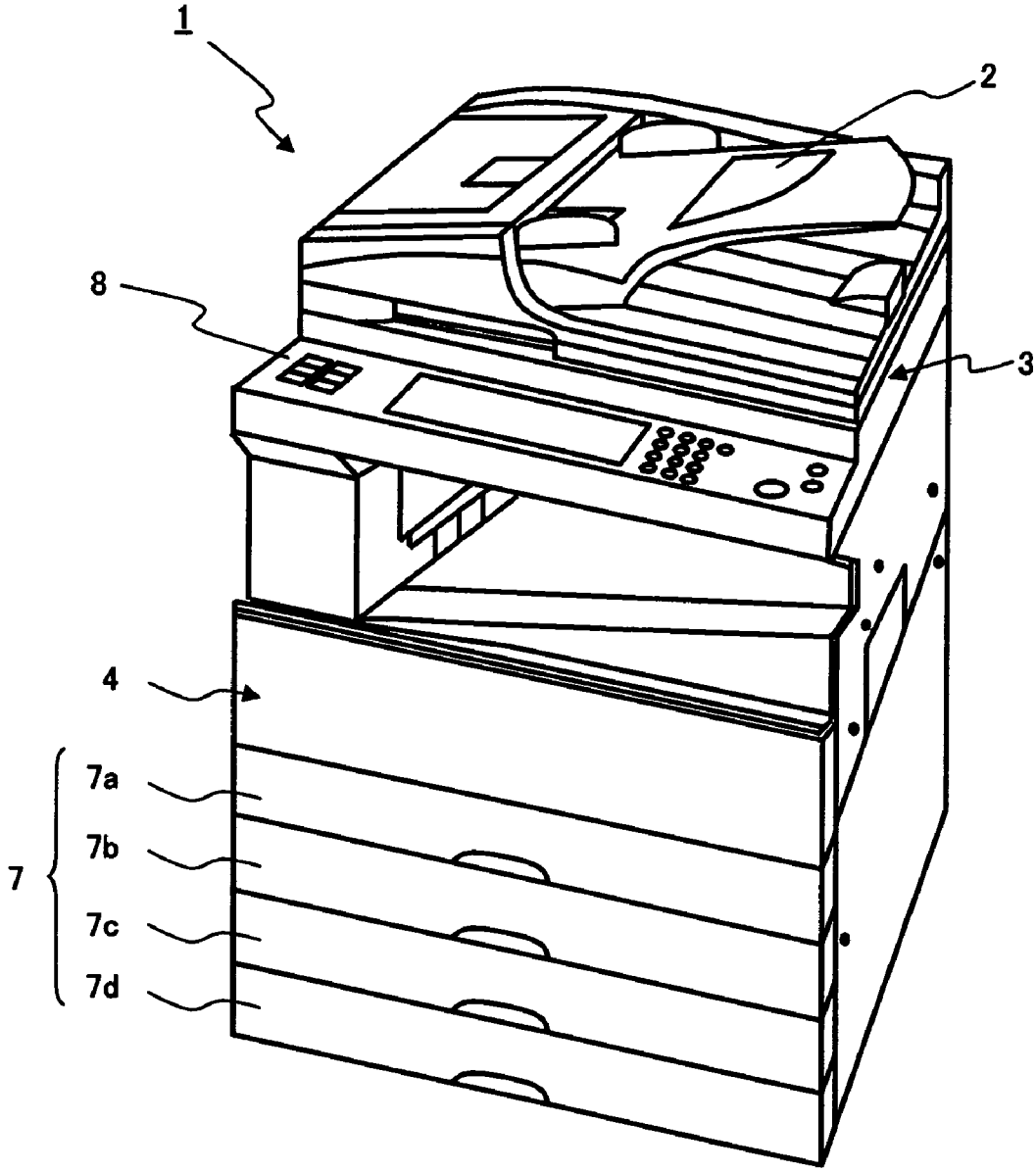
FIG. 2 is an external view of a digital copier (image forming apparatus) to which the present invention is applied.
Figure 3:
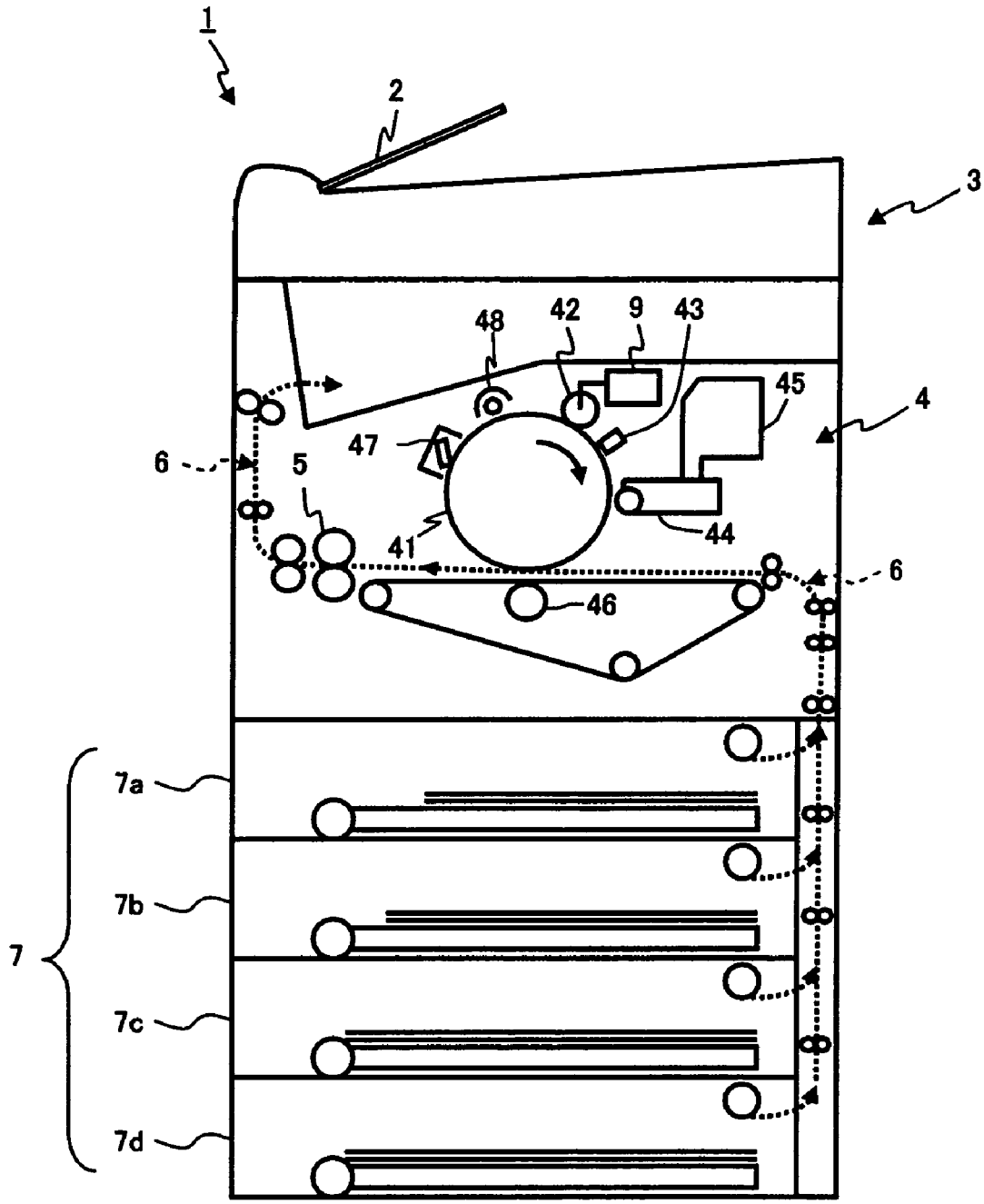
FIG. 3 is an illustrative diagram of the digital copier to which the present invention is applied.

As shown in FIGS. 2 and 3, a digital copier 1 includes functional blocks such as a document placing portion 2 on which a document is set; an image reading portion 3 that reads a document image and converts the document image into electronic data; an image forming portion 4 that forms a toner image on a sheet based on the image data converted into electronic data by the image reading portion 3; a fusing portion 5 that heats and fuses the toner image formed on the sheet; a plurality of paper feed cassettes 7 (7*a* to 7*d*) that each contain different sizes or different types of sheets; a transporting portion 6 that transports the sheets contained in the paper feed cassettes 7 (7*a* to 7*d*) to the image forming portion 4; and an operation portion 8 having disposed thereon a plurality of menu setting keys for setting various copying menus, and the like.

As shown in FIG. 3, an image carrier 41 is provided in the image forming portion 4. Around the image carrier 41 are disposed a charging member 42, a print head 43, a developing portion 44, a transferring portion 46, a cleaner portion 47, and a charge eliminating lamp 48 along a rotating direction of the image carrier 41.

The image carrier 41 is constituted by a photoconductor drum having a photosensitive layer having amorphous silicon, which is a positively charged photoconductor, deposited on a surface of an aluminum cylinder. The image carrier 41 is rotatingly driven around a central axis of the photoconductor drum by a drive apparatus.

The charging member 42 is constituted by a charging roller in which an epichlorohydrin rubber layer 422 which is a conductive elastic material is coated over a cored bar 421. The charging member 42 is disposed so as to contact the photoconductor drum.

A toner cartridge 45, which is a replaceable unit, is provided to the developing portion 44, whereby toner is stably supplied into the developing portion 44.

An image forming process will be described.

The image carrier 41 uniformly charged by the charging member 42 is exposed by the print head 43 which is driven based on image data, whereby an electrostatic latent image is formed. Then, the electrostatic latent image is visualized by toner which is electrostatically adhered to the electrostatic latent image by the developing portion 44.

Residual toner left after a toner image formed on the image carrier 41 is transferred onto a sheet by the transferring portion 46 is collected by the cleaner portion 47, and a residual potential of the image carrier 41 is erased by the charge eliminating lamp 48. A series of image forming processes from charging to erasing corresponds to a printing process for a single sheet, and by repeating such an image forming process, a continuous printing process is implemented.

Figure 4:
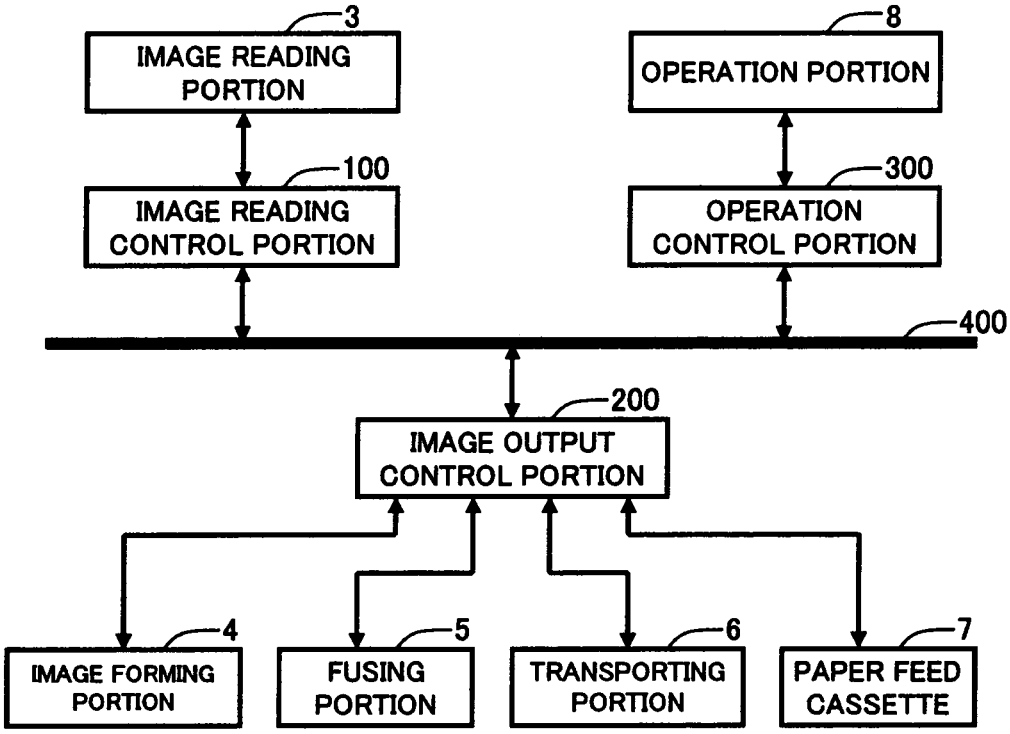
FIG. 4 is a block diagram of a control portion of the digital copier.

As shown in FIG. 4, a plurality of control portions for controlling the above-described functional blocks are provided in the digital copier 1. Specifically, there are provided an image reading control portion 100 that controls a document reading operation performed by the image reading portion 3; an image output control portion 200 that performs overall control over the system of the digital copier 1 and controls the image forming portion 4, the fusing portion 5, the transporting portion 6, and the sheet feed cassettes 7; an operation control portion 300 that controls input and output signals of the operation portion 8; and the like.

The control portions 100, 200, and 300 are each constituted by a single or a plurality of control boards having provided thereon a single or a plurality of CPUs; a ROM having stored therein a control program and the like, which are executed by the CPU(s); a RAM that stores control data; an input/output interface circuit that outputs a signal to various loads to be controlled and accepts input of detection values from various sensors; and the like.

The CPUs are interconnected to one another with a serial communication line 400, whereby a distributed control system is constructed. In the digital copier 1, a predetermined image forming operation is implemented by the functional blocks operating in a coordinated fashion by a control program executed by each CPU and associated hardware.

An output line of a charging control apparatus 9 is connected to the charging member 42, whereby a high voltage for controlling the charging voltage to the image carrier 41 is applied.

Figure 1:
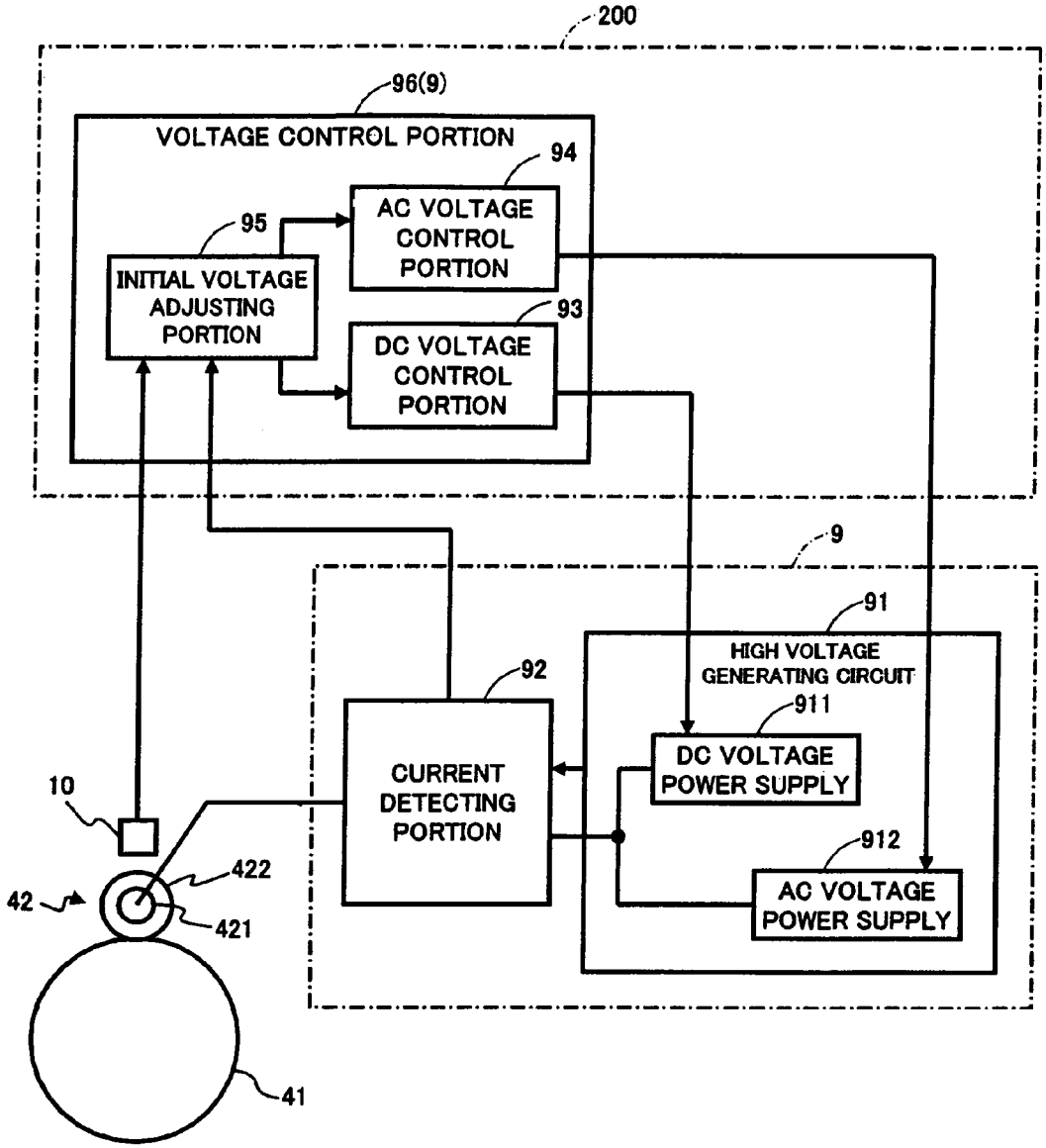
FIG. 1 is a block diagram of a charging control apparatus to which the present invention is applied.

As shown in FIG. 1, the charging control apparatus 9 includes a high voltage generating circuit 91 that applies an oscillating voltage in which a DC voltage and an AC voltage are superimposed on each other, to the charging member 42; a current detecting portion 92 that detects a DC current value between the image carrier 41 and the charging member 42;

and a voltage control portion 96 that controls an output voltage of the high voltage generating circuit 91. An environmental sensor 10 that detects temperature and humidity is installed near the charging member 42 and a detection signal from the environmental sensor 10 is inputted to the voltage control portion 96.

The high voltage generating circuit 91 includes a DC voltage power supply 911 that converts an AC high voltage which is raised by a pulse transformer into a DC voltage and outputs the DC voltage; and an AC voltage power supply 912 that outputs an AC high voltage of a sine wave with a predetermined frequency which is raised by the pulse transformer as well.

The current detecting portion 92 detects a DC current value that flows between the image carrier 41 and the charging member 42 by an oscillating voltage applied to the charging member 42 from the high voltage generating circuit 91.

The voltage control portion 96 is embodied by the CPU(s), a peripheral circuit and a control program which are incorporated in the image output control portion 200, and includes a DC voltage control portion 93 that controls an output level of the DC voltage power supply 911; an AC voltage control portion 94 that controls an output level of the AC voltage power supply 912; and an initial voltage adjusting portion 95.

The DC voltage control portion 93 controls the DC voltage power supply 911 such that a DC voltage having a value set by the initial voltage adjusting portion 95 is applied to the charging member 42. The set value of a DC voltage is a value (e.g., 400 V) obtained when, while assembling the digital copier 1, the charging potential of the image carrier 41 is adjusted to a predetermined value (e.g., 300 V) in a standard environment.

The AC voltage control portion 94 controls the AC voltage power supply 912 such that an AC voltage having a peak-to-peak voltage value Vpp which is set by the initial voltage adjusting portion 95 is applied to the charging member 42.

The initial voltage adjusting portion 95 rotatingly drives the image carrier 41, sets a DC voltage value to a preset value while lighting up and driving the charge eliminating lamp 48, and controls the DC voltage control portion 93 and the AC voltage control portion 94 such that a peak-to-peak voltage of an AC voltage gradually increases from the low voltage side to the high voltage side while monitoring a DC current value which is detected by the current detecting portion 92.

For example, a peak-to-peak voltage value Vpp is incremented by 100 V from 400 V to 1500 V at intervals of 0.5 second and a DC current value obtained during a period in which each peak-to-peak voltage value Vpp is outputted for 0.5 second is monitored.

Then, the initial voltage adjusting portion 95 gradually increases a peak-to-peak voltage until the amount of increase in DC current value obtained when the peak-to-peak voltage is changed, i.e., a difference between a DC current value obtained upon the last AC voltage application and a DC current value obtained upon the current AC voltage application, becomes less than or equal to a predetermined value, and sets a peak-to-peak voltage obtained when the difference becomes less than or equal to the predetermined value, as a target voltage.

The initial voltage adjusting portion 95 operates based on an input signal from the operation control portion 300 or the like, when it is determined that the power to the digital copier 1 has been turned on or after the turning-on of the power the digital copier 1 has returned to a normal mode in which a copying operation can be performed, from a power saving mode. Such a target voltage setting operation by the initial voltage adjusting portion 95 is referred to as a charging calibration process.

More specifically, the initial voltage adjusting portion 95 sequentially stores a DC current value detected by the current detecting portion 92 in the RAM of the image output control portion 200 and calculates a difference between the latest detected DC current value and the one detected just before it. When the difference is less than or equal to a preset value, the initial voltage adjusting portion 95 stores a peak-to-peak voltage value Vpp corresponding to the latest detected DC current value, in the RAM as a target voltage value.

Note that, taking into account errors or the like, it is preferable that the target voltage value is set to a value slightly greater, e.g., by the order of 5 to 10%, than a determined peak-to-peak voltage value Vpp.

On the other hand, when the difference calculated by the initial voltage adjusting portion 95 is greater than the preset value, the initial voltage adjusting portion 95 increases the peak-to-peak voltage value Vpp until the peak-to-peak voltage value Vpp reaches a limit value (1500 V in the present embodiment but the value is not limited thereto) and determines a peak-to-peak voltage value Vpp to be obtained when the difference is less than or equal to the preset value.

Generally, when the power is turned on or when the apparatus returns to a normal mode in which a copying operation can be performed, from a power saving mode, loads on the fusing portion and various power systems are stopped. Thus, the temperature inside the apparatus does not increase so much, and thus the environmental temperature around the image forming portion 4 is low.

Figure 8:
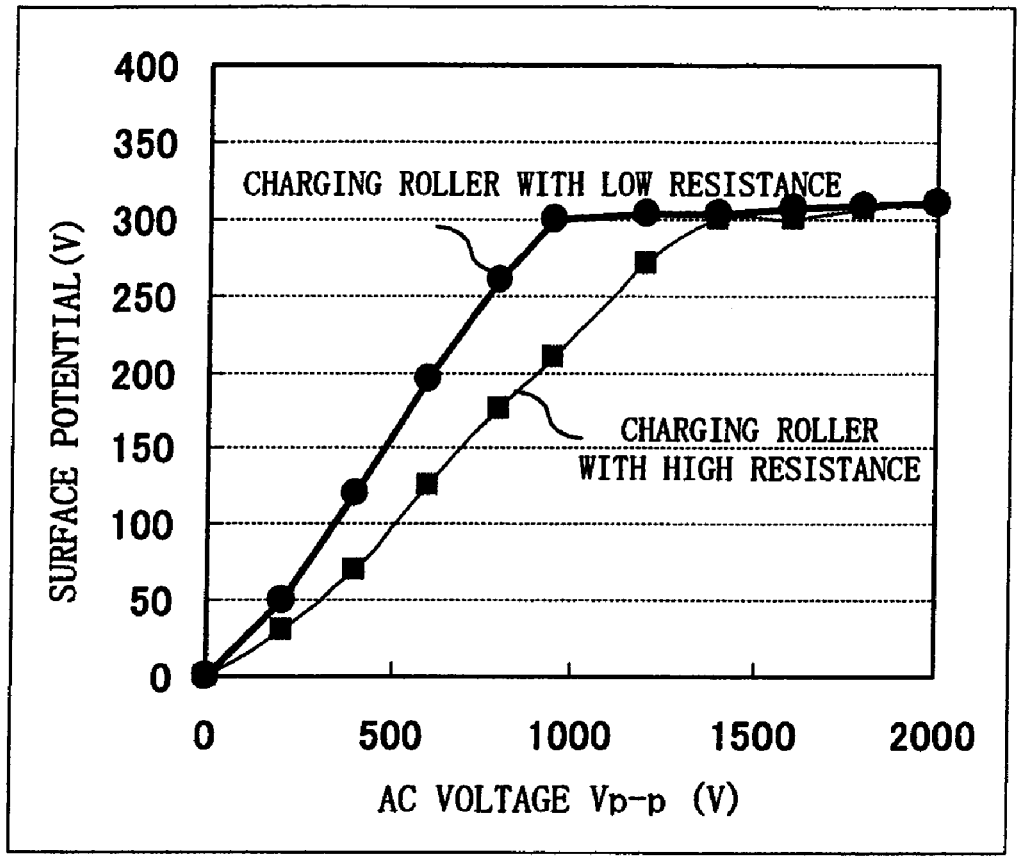
FIG. 8 is a characteristic diagram of a peak-to-peak voltage value of an AC voltage at low temperatures and at high temperatures with respect to a photoconductor surface potential.
Figure 9:
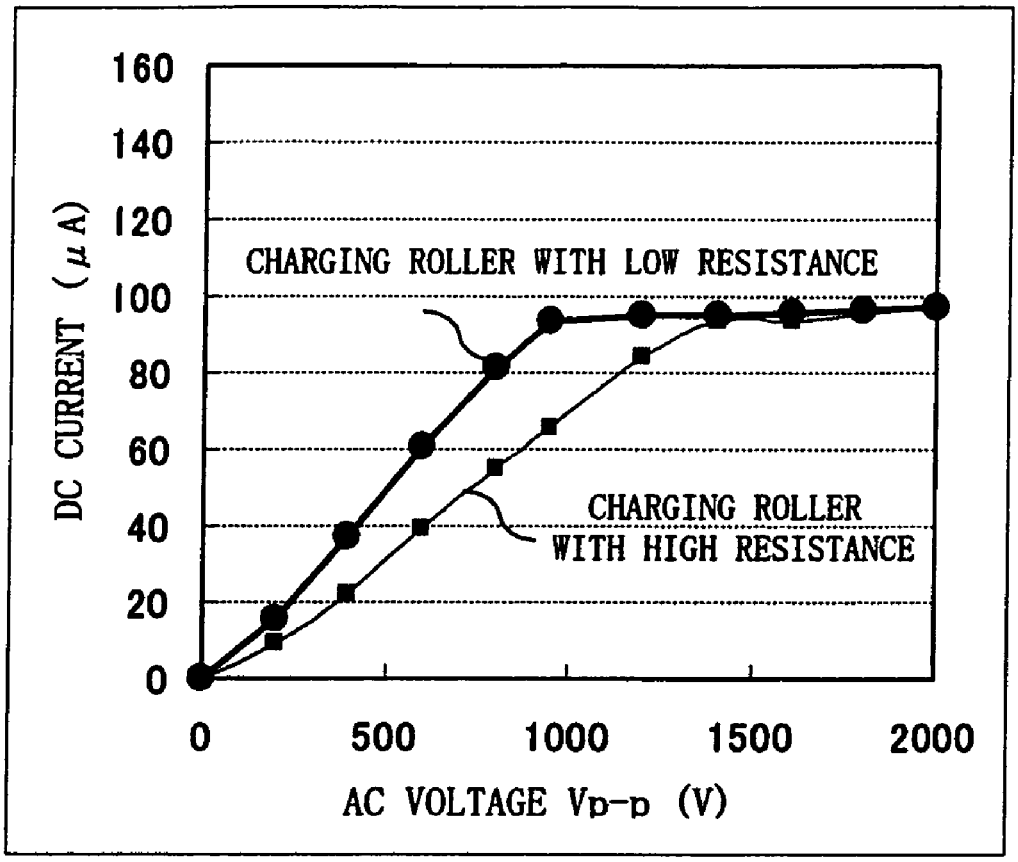
FIG. 9 is a characteristic diagram of a peak-to-peak voltage value of an AC voltage at low temperatures and at high temperatures with respect to a DC current value.
Figure 10:
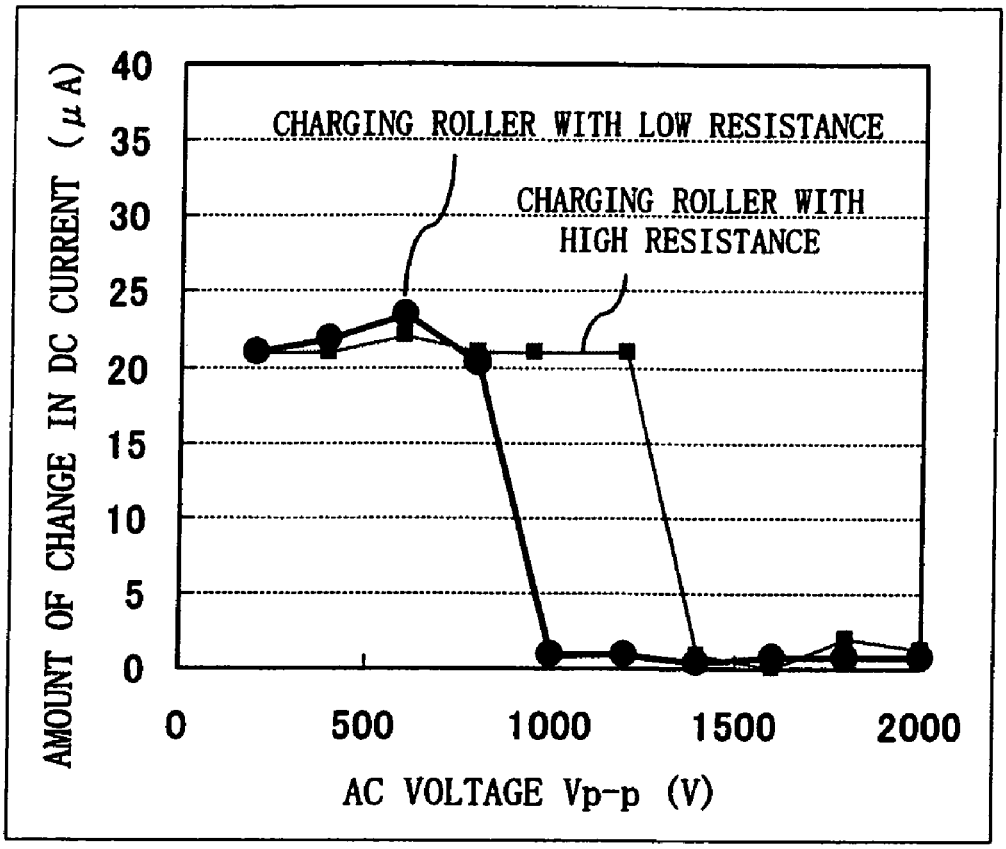
FIG. 10 is a characteristic diagram of the amount of change in DC current value when a peak-to-peak voltage value of an AC voltage at low temperatures and at high temperatures is changed.

As shown in FIGS. 8 to 10, the resistance of an epichlorohydrin-based rubber which is used in the charging member has temperature characteristics and humidity characteristics, and a high resistance value is exhibited in a low temperature environment. When calibration is performed in such a low temperature environment, a peak-to-peak voltage of an AC voltage is adjusted in accordance with a resistance value of the charging member corresponding to the temperature at that time.

However, when the temperature of the charging member increases with a later increase in environmental temperature and the resistance value of the charging member decreases accordingly, it invites a situation where a peak-to-peak voltage which is exceptionally higher than a target, appropriate peak-to-peak voltage corresponding to a charging voltage of the image carrier is applied. As a result, the amount of discharge product that adheres to the image carrier increases, which may cause inconvenience such as cleaning failure and an image flow.

In view of this, the image output control portion 200 is configured such that if an image forming operation is started when a target voltage which is adjusted by the initial voltage adjusting portion 95 upon turning on of the power and the like, is greater than or equal to a predetermined voltage value and/or when an environmental temperature and an environmental humidity of the charging member which are detected by the environmental sensor 10 satisfy predetermined conditions, then the image output control portion 200 temporarily suspends the image forming operation after the image forming operation is started, and the initial voltage adjusting portion 95 performs an interrupt operation.

Note that the configuration may be such that, regardless of the environmental temperature and humidity, once an image forming operation is started, the image forming operation is temporarily suspended after the start of the image forming operation, and then the initial voltage adjusting portion 95 performs an interrupt operation.

An example of the charging calibration process which is performed interrupting an image forming operation being performed, will be described in detail below.

When the initial voltage adjusting portion 95 performs a charging calibration process upon turning on of the power or upon returning from the power saving mode, the initial voltage adjusting portion 95 determines whether a temperature detected by the environmental sensor 10 satisfies a predetermined condition (15° C. or less in the present embodiment but the temperature is not limited thereto) and a humidity detected by the environmental sensor 10 satisfies a predetermined condition (60% RH or greater in the present embodiment but the humidity is not limited thereto) and stores results of the determination in the RAM.

The initial voltage adjusting portion 95 stores in the RAM a target voltage set in the charging calibration process performed at this time. When the temperature and the humidity satisfy the above-described predetermined conditions and the target voltage is greater than or equal to a predetermined voltage value (1400 V in the present embodiment), the initial voltage adjusting portion 95 sets a flag that enables an interrupt process in the RAM.

When the charging calibration process is completed and a print start key is operated on the operation portion 8, an image forming process is performed by the image output control portion 200. When the flag is set, the image output control portion 200 suspends the image forming process every certain period of time (every 60 seconds in the present embodiment but the time is not limited thereto) and activates the initial voltage adjusting portion 95 to perform a charging calibration process. When the charging calibration process is completed, the image output control portion 200 resumes the suspended image forming process.

The charging calibration process which is intermittently performed by an interrupt during a series of image forming processes is repeated a preset number of times (the number is set to ten in the present embodiment but is not limited thereto).

When a target voltage set in a charging calibration process which is performed by an interrupt operation falls below the predetermined voltage value, the flag is reset, and a subsequent interrupt operation does not take place.

Due to the execution of an image forming process, the environmental temperature gradually increases, and the environmental humidity gradually decreases, so that the resistance value of an epichlorohydrin-based rubber which is used in the charging member decreases. By a charging calibration process which is performed by an interrupt operation, the voltage is set to an appropriate value corresponding to the resistance value of the epichlorohydrin-based rubber at that time.

The operation of the initial voltage adjusting portion 95 which is performed when the power to the digital copier 1 is turned on or when the digital copier 1 returns from the power saving mode will be described based on a flowchart shown in FIG. 5.

When the power to the digital copier 1 is turned on or when the digital copier 1 returns from the power saving mode (SA1), the initial voltage adjusting portion 95 rotatingly drives the image carrier 41 and lights up the charge eliminating lamp 48 and then applies a DC voltage and an AC voltage which have preset values to the charging member 42 (SA2).

The initial voltage adjusting portion 95 detects, through the current detecting portion 92, a DC current value which flows through the image carrier 41 from the charging member 42 by the application of an oscillating voltage (SA3) and calculates a difference between the detected DC current value and a DC current value detected last time and stored in the RAM (SA4).

If the difference is substantially zero (SA5), then the initial voltage adjusting portion 95 sets a peak-to-peak voltage value Vpp corresponding to the DC current value detected this time as a target voltage value and stores the value in the RAM (SA6).

On the other hand, if the difference is greater than substantially zero (SA5) and the current peak-to-peak voltage value Vpp is less than or equal to a limit value (1500 V) (SA7), then the peak-to-peak voltage value Vpp is increased by 100 V (SA8), and an oscillating voltage is applied to the charging member 42 (SA9).

If the difference is greater than substantially zero (SA5) and the current peak-to-peak voltage value Vpp is higher than the limit value (SA7), then the initial voltage adjusting portion 95 displays, through the operation control portion 300, a warning message indicating that the adjustment cannot be made, on a liquid crystal touch panel provided on the operation portion 8 and ends the charging calibration process (SA10).

Figure 6:
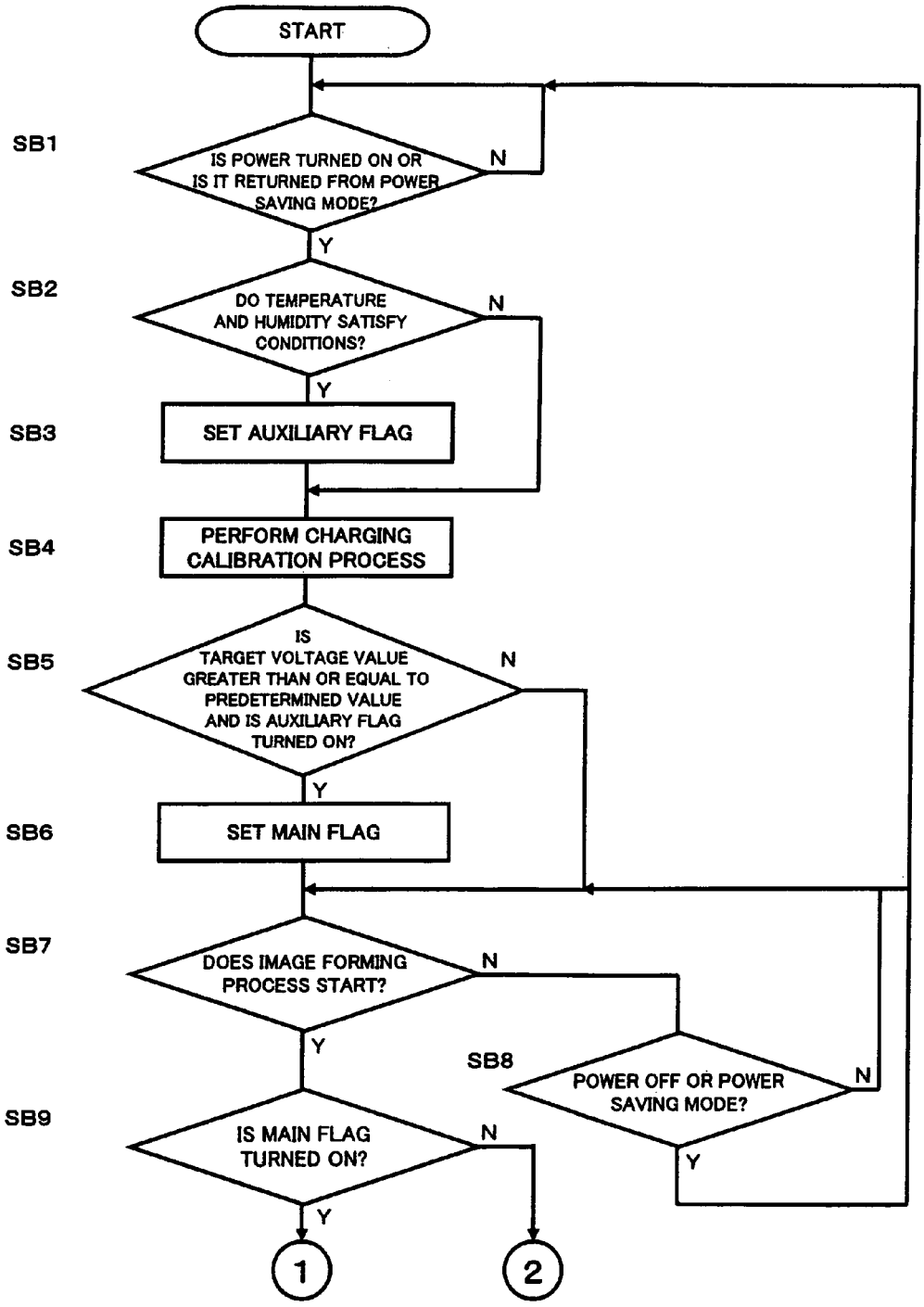
FIG. 6 is a flowchart illustrating a charging calibration process which is performed by an interrupt.
Figure 7:
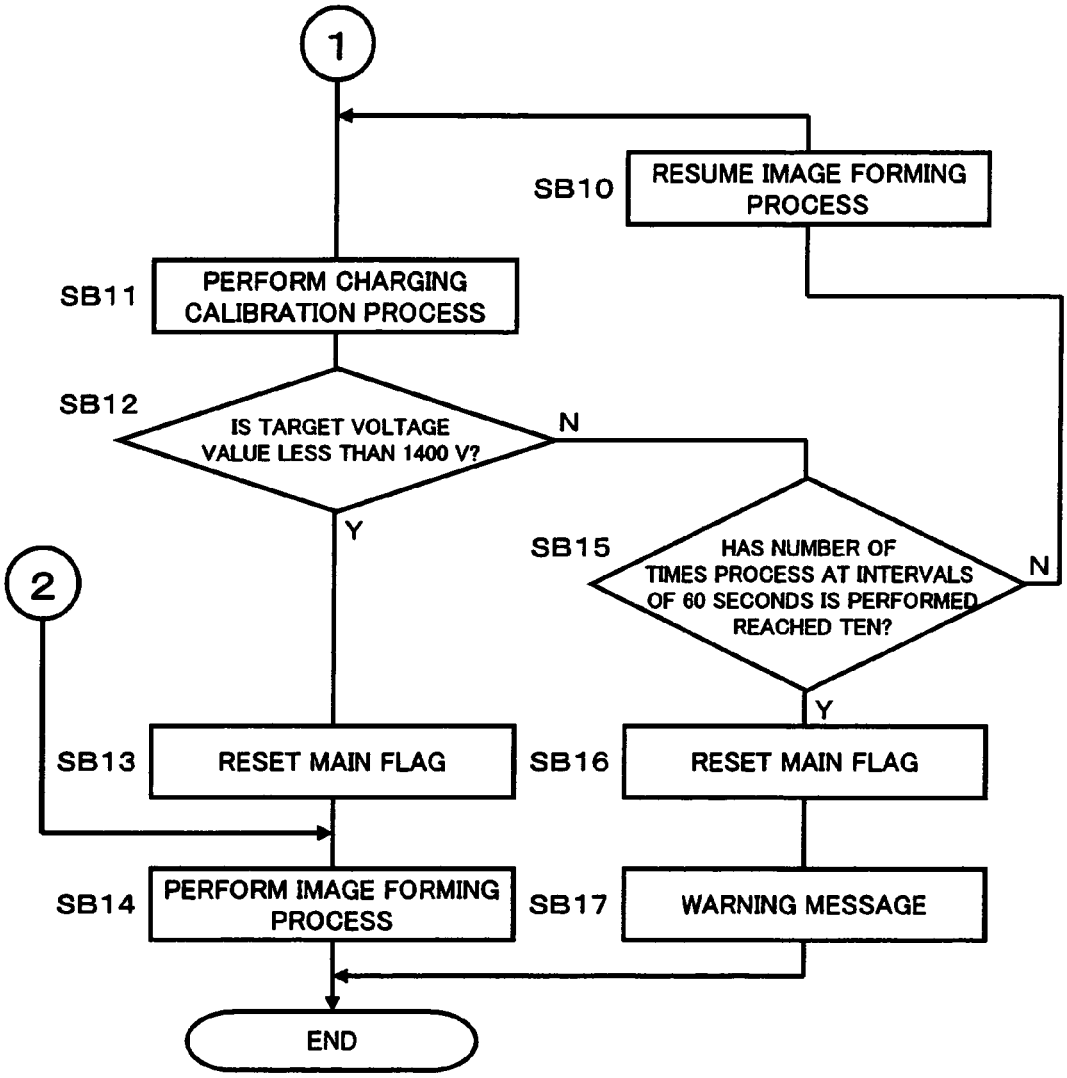
FIG. 7 is a flowchart illustrating the charging calibration process which is performed by an interrupt.

Next, the operation of the initial voltage adjusting portion 95 including the charging calibration process which is performed interrupting an image forming process being performed will be described based on flowcharts shown in FIGS. 6 and 7.

When the power to the digital copier 1 is turned on or when the digital copier 1 returns from the power saving mode (SB1), the initial voltage adjusting portion 95 determines whether a temperature detected by the environmental sensor 10 is 15° C. or less and a relative humidity detected by the environmental sensor 10 is 60% or greater (SB2) and sets an auxiliary flag when such conditions are satisfied (SB3).

Figure 5:
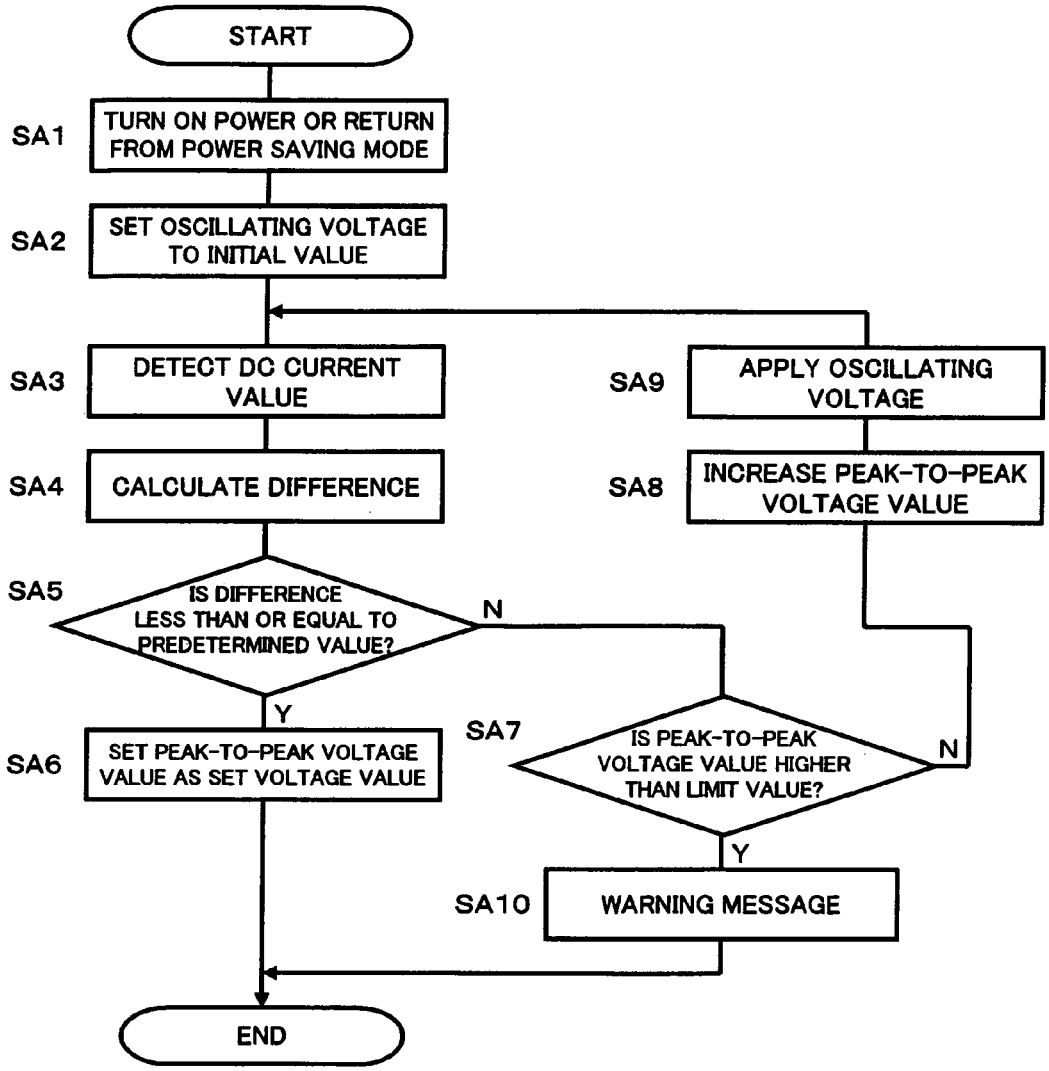
FIG. 5 is a flowchart illustrating an initial charging calibration process.

Thereafter, the initial charging calibration process which has been described referring to FIG. 5 is performed (SB4), and it is determined whether a target voltage value determined in step SB4 is 1400 V or greater (SB5). If the target voltage value is 1400 V or greater and the auxiliary flag is set in step SB3, then a main flag is set (SB6).

If, after the initial charging calibration process is completed, an image forming process does not start (SB7) and the power is turned off or the digital copier 1 shifts to the power saving mode (SB8), the process from step SB1 is repeated when the power is turned on again or when the digital copier 1 returns from the power saving mode.

On the other hand, if, upon starting an image forming process (SB7), the main flag is not set (SB9), then a normal image forming process is performed by the image output control portion 200 (SB14), and if the main flag is set (SB9), then the image forming process is suspended and a charging calibration process as in step SB4 is performed (SB11).

If a target voltage value set in the charging calibration process in step SB11 is less than 1400 V (SB 12), then the initial voltage adjusting portion 95 resets the main flag and the auxiliary flag (SB13) and resumes the image forming process performed by the image output control portion 200 (SB14).

On the other hand, if the target voltage value set in the charging calibration process in step SB11 is 1400 V or greater (SB12) and the number of times the charging calibration process at intervals of 60 seconds is performed has not reached ten (5B15), then the initial voltage adjusting portion 95 resumes the image forming process performed by the image output control portion 200 (SB10). Note that the initial voltage adjusting portion 95 stores and manages the number of times the charging calibration process is performed, in the RAM.

If the target voltage value set in the charging calibration process in step SB11 is 1400 V or greater (SB12) and the number of times the charging calibration process at intervals of 60 seconds is continuously performed has reached ten (SB15), then the initial voltage adjusting portion 95 resets the main flag (SB16), displays, through the operation control portion 300, a warning message on the liquid crystal touch panel provided on the operation portion 8, and ends the charging calibration process by an interrupt (SB17).

Another embodiment will be described below. Although the above-described embodiment describes an example case in which a photoconductor drum in which amorphous silicon is adopted in the photosensitive layer is adopted as the image carrier 41, the present invention is also applicable to an image forming apparatus having a photoconductor other than the amorphous silicon photoconductor. For example, the present invention can also be applied to an image forming apparatus having an organic photoconductor or selenium photoconductor. However, the present invention is particularly effective with amorphous silicon that has a hard surface layer.

Although the above-described embodiment describes that the charging member 42 is configured as a charging roller in which the epichlorohydrin rubber layer 422 is coated over the cored bar 421, even when the charging member 42 is configured as a charging blade over which an epichlorohydrin rubber layer 422 is coated, the present invention can be applied.

Note that the charging member 42 need not necessarily be disposed in contact with the image carrier 41, and the charging member 42 may be disposed close to the image carrier 41 with a slight gap therebetween.

Also note that the waveform of the AC voltage which is superimposed on a DC voltage as an oscillating voltage is not limited to a sine wave and may be a rectangular wave, a triangular wave, a pulse wave, or the like.

What is claimed is:

1. An image forming apparatus including an image carrier, the image forming apparatus comprising:

a charging member disposed in contact with or close to the image carrier so as to charge the image carrier, said charging member having a resistance value which varies according to at least one of an environmental temperature or an environmental humidity of the image forming apparatus;

a high voltage generating circuit that applies an oscillating voltage to the charging member, wherein the oscillating voltage comprises a DC voltage and an AC voltage superimposed on each other;

a voltage control portion that controls the high voltage generating circuit such that a peak-to-peak voltage value of the AC voltage reaches a target voltage value; and the voltage control portion having an initial voltage adjusting portion that is configured to perform a target voltage setting operation to set the target voltage value upon determination that power to the image forming apparatus is turned on and upon determination that the image forming apparatus returns from a power saving mode, the target voltage setting operation including:

performing a first determination determining if a predetermined environmental condition exists, said predetermined environmental condition including at least one of an environmental temperature or an environmental humidity of the image forming apparatus;

performing a calibration process setting the target voltage value;

performing a second determination determining if the target voltage value is greater than or equal to a predetermined voltage value; and interrupting an image forming process being performed to suspend the image forming process and then again performing the calibration process to set the target voltage value in response to both the first determination and the second determination being positive.

2. The image forming apparatus according to claim 1, further comprising a current detection portion that detects a DC current value of a current flowing between the image carrier and the charging member, wherein the initial voltage adjusting portion sets the peak-to-peak voltage value as the target voltage value, the peak-to-peak voltage value being obtained when a change of the DC current value is less than or equal to a predetermined value, the change of the DC current value being detected by the current detecting portion when the peak-to-peak voltage of the AC voltage is gradually increased.

3. The image forming apparatus according to claim 1, wherein the initial voltage adjusting portion repeatedly interrupts the image forming process being performed, at predetermined intervals to set the target voltage value.

4. The image forming apparatus according to claim 1, wherein the initial voltage adjusting portion repeatedly interrupts the image forming process being performed, at predetermined intervals with a limit of a preset number of times to set the target voltage value.

5. The image forming apparatus according to claim 1, wherein the initial voltage adjusting portion interrupts the image forming process being performed, until the target voltage value set upon an interrupt falls below the predetermined voltage value, to set the target voltage value.

* * * * *